US009462900B2

(12) United States Patent
Esposito

(10) Patent No.: US 9,462,900 B2
(45) Date of Patent: Oct. 11, 2016

(54) MEASURING APPARATUS FOR FASTENING ONE OR MULTIPLE OBJECTS AT DESIRED POSITIONS

(71) Applicant: John L. Esposito, Conroe, TX (US)

(72) Inventor: John L. Esposito, Conroe, TX (US)

( * ) Notice: Subject to any disclaimer, the term of this patent is extended or adjusted under 35 U.S.C. 154(b) by 141 days.

(21) Appl. No.: 13/737,498

(22) Filed: Jan. 9, 2013

(65) Prior Publication Data

US 2013/0333233 A1 Dec. 19, 2013

Related U.S. Application Data

(60) Provisional application No. 61/584,784, filed on Jan. 9, 2012.

(51) Int. Cl.

| | |
|---|---|
| ***A47G 1/16*** | (2006.01) |
| ***A47G 1/20*** | (2006.01) |
| ***B25H 7/04*** | (2006.01) |

(52) U.S. Cl.

CPC ..... *A47G 1/16* (2013.01); *A47G 1/205* (2013.01); *B25H 7/04* (2013.01)

(58) Field of Classification Search

CPC .... A47G 1/205; E04G 21/1891; G01B 5/14; G01C 9/28; G01C 9/12; G01C 9/14

USPC ..... 33/370, 613, 374, 383

See application file for complete search history.

(56) References Cited

U.S. PATENT DOCUMENTS 986,001 A * 3/1911 Hendrickson ..... G01B 3/56 33/341
1,200,410 A * 10/1916 Chemrinsky ..... G01C 9/28 33/370
2,559,961 A * 7/1951 Howell ..... F16C 1/04 33/374
2,654,538 A * 10/1953 Fuller ..... G06G 1/0005 235/61 GM
3,197,874 A * 8/1965 Fox ..... B25H 7/04 33/194
3,851,868 A * 12/1974 Lagasse ..... E04F 21/0015 269/208
3,947,970 A * 4/1976 Lesure ..... G01C 9/28 33/349
4,099,331 A * 7/1978 Peterson ..... G01C 9/28 33/374
4,228,982 A 10/1980 Sellera
4,607,437 A * 8/1986 McSorley, Sr. ..... G01C 9/28 33/374
4,625,415 A * 12/1986 Diamontis ..... E04G 21/1891 33/562
5,001,838 A * 3/1991 Huxley ..... G01C 9/24 33/384
5,069,411 A * 12/1991 Murphy ..... 248/476
5,412,875 A * 5/1995 Hilderbrandt ..... G01C 9/28 33/374

(Continued)

FOREIGN PATENT DOCUMENTS

WO WO 2007106970 A1 * 9/2007

*Primary Examiner* — Yaritza Guadalupe-McCall

(74) *Attorney, Agent, or Firm* — The Kubiak Law Firm, PLLC

(57) ABSTRACT

An apparatus for fastening one or multiple objects to a wall or other surface includes first and second frame members, movable relative to one another along an axis. First and second engagement members extend from the first and second frame members, respectively, the engagement members being usable to engage fastening regions of one or more objects to be secured, then subsequently to provide visible markings to the surface. One or more angular measurement devices engaged with one or both the frame members can be used to record the angular relationship between fastening regions, while the position of the frame members relative to one another can be used to record the linear distance between fastening regions. The markings provided to the mounting surface thereby have the same linear and angular relationship as the fastening regions due to the angular and linear position of the frame members.

9 Claims, 8 Drawing Sheets

(56) References Cited

U.S. PATENT DOCUMENTS

| | | | | |
|---|---|---|---|---|
| 5,634,279 | A * | 6/1997 | Ariyo | 33/462 |
| 5,669,593 | A | 9/1997 | Kirchner | |
| 6,195,902 | B1 | 3/2001 | Jan et al. | |
| 6,357,716 | B1 * | 3/2002 | Kratish | A47G 1/205 248/466 |
| 6,393,715 | B1 * | 5/2002 | Ihle | 33/669 |
| 6,421,928 | B1 * | 7/2002 | Miller | 33/520 |
| 6,658,753 | B2 * | 12/2003 | Tatarnic | G01C 15/02 33/613 |
| 6,785,977 | B1 * | 9/2004 | Crichton | 33/613 |
| 6,836,973 | B1 * | 1/2005 | Eccles, Jr. | G01C 9/28 33/374 |
| 6,880,259 | B1 | 4/2005 | Schultz | |
| 7,089,679 | B2 | 8/2006 | Brown | |
| 7,159,328 | B1 * | 1/2007 | Duda | 33/647 |
| 7,185,442 | B2 | 3/2007 | Grillo | |
| 7,188,427 | B2 | 3/2007 | Johnson | |
| 7,350,312 | B1 | 4/2008 | Grillo | |
| 7,607,631 | B2 | 10/2009 | Newman | |
| 7,743,520 | B1 | 6/2010 | Jiorle | |
| RE42,649 | E | 8/2011 | Schultz | |
| 2002/0078582 | A1 | 6/2002 | Krake et al. | |
| 2002/0078583 | A1 * | 6/2002 | Richardson | G01B 3/08 33/613 |
| 2002/0121026 | A1 * | 9/2002 | Pustay | G01C 9/28 33/374 |
| 2003/0033722 | A1 | 2/2003 | Lanham | |
| 2003/0051363 | A1 | 3/2003 | Hofmeister et al. | |
| 2004/0026593 | A1 | 2/2004 | Fay | |
| 2004/0177527 | A1 | 9/2004 | Prevost | |
| 2005/0263654 | A1 | 12/2005 | Grillo | |
| 2006/0123644 | A1 * | 6/2006 | Szumer | G01C 9/28 33/374 |
| 2006/0174503 | A1 | 8/2006 | Johnson | |
| 2006/0231721 | A1 | 10/2006 | Robie | |
| 2006/0278799 | A1 | 12/2006 | Newman | |
| 2007/0023605 | A1 | 2/2007 | Schlais et al. | |
| 2008/0105813 | A1 * | 5/2008 | Schapanski | 248/476 |
| 2008/0196262 | A1 | 8/2008 | Bommarito | |
| 2008/0237433 | A1 | 10/2008 | Hardin | |
| 2009/0045315 | A1 | 2/2009 | Harralson et al. | |
| 2009/0261227 | A1 * | 10/2009 | Venderley et al. | 248/488 |
| 2009/0313843 | A1 | 12/2009 | Compton | |
| 2010/0012813 | A1 | 1/2010 | Mickel | |
| 2010/0325905 | A1 | 12/2010 | Coyle | |
| 2012/0246957 | A1 * | 10/2012 | Daniel | 33/645 |

* cited by examiner 68
69
71
70
72
62
64
66
74
76
80
82
84

68
69
71
70
73
72
62
64
66
74
76
80
82
85

56
60
58

10
34
36
30
56
60
58

56

43
45
35
31
47
12
10
44
42
46
34
30

MEASURING APPARATUS FOR FASTENING ONE OR MULTIPLE OBJECTS AT DESIRED POSITIONS

CROSS-REFERENCE TO RELATED APPLICATIONS

The present application claims priority to the U.S. provisional application for patent, filed Jan. 9, 2012, having the application Ser. No. 61/584,784, the entirety of which is incorporated herein by reference.

FIELD

Embodiments usable within the scope of the present invention relate generally to apparatus and methods usable to position (e.g., align, space, hang, and/or otherwise suspend) one or multiple objects, such as pictures, shelves, televisions, drapery rods, racks, etc., at desired locations, e.g., for fastening the objects thereto.

BACKGROUND

Conventionally, when hanging a framed picture, a shelf, a mirror, a towel rack, or a similar object at a desired location along a wall or other surface, it is necessary to employ a variety of measuring devices and other tools, such as a ruler, tape measure, or similar apparatus used to measure lengths and distances, a bubble or laser leveler or similar angular measurement and/or verification device, a marking implement, and appropriate fasteners (e.g., nails, screws, pushpins, hooks, etc.). Such a process, while deceptively simple in appearance, can require multiple measurement steps, and other intermediate steps, such as visibly marking a measurement with an implement, and verifying measurements, each of such steps being subject to user error. The accumulation of error across multiple steps can often result in objects that are hung improperly, or the placement of fasteners in a manner that can cause an object to be impossible to position, requiring the entire process, or portions thereof, to be performed again, when performance of these steps often requires marking and/or forming orifices in walls, and other damaging and irreversible steps.

For example, a user may choose to measure the length of a wall or a portion thereof, when desiring to position a picture or other object centrally or at another desired position thereon. The user would then measure the width of the picture to determine a position, such that the picture is properly located. It is also normally necessary to measure the location at which fasteners and/or fastening regions in the picture are located. Many pictures, shelves, and similar objects include orifices formed in the back surface thereof, proximate to the edge, such that a hook, pushpin, or similar fastener engaged with the wall can be positioned in the orifice, whereby contact between the fastener and the perimeter of the orifice suspends the object at the desired position along the wall. With each measuring step, a user may choose to make a visible marking on the wall, such as through use of a pencil, or through use of a nail, pin, or similar sharp implement to form a small indentation in the wall. It is often necessary to hold a picture or similar object against a wall for verification purposes and/or to make or adjust visible markings. For objects having multiple fastening regions, a level is typically used to attempt to align corresponding holes and fasteners in a wall and to ensure that the object, once hung, will have a generally straight, horizontal orientation.

As such, extremely precise measurements and unreasonable physical precision are required to ensure that fasteners for accommodating an object are placed in a wall at locations that are properly spaced to correspond to the location of fastening regions on a picture or similar object, and that are placed in a manner that ensures the object will be suspended with a generally straight, level orientation. The potential for error increases significantly when it is desired to hang multiple pictures, or similar objects, each object being positioned in horizontal or vertical alignment with each other object, or when it is desired to hang individual objects and/or position adjacent objects at non-standard angles (e.g., not vertical or horizontal).

A need exists for apparatus and methods usable to efficiently and accurately acquire both linear and angular measurements, e.g., relative to fastening regions of an object for enabling fasteners corresponding to the fastening regions to be rapidly and accurately positioned.

A need also exists for apparatus and methods usable to efficiently position multiple objects relative to one another at any desired spacing and/or angle.

A further need exists for apparatus and methods able to be used by a single individual to quickly and efficiently align, position, and/or secure or multiple objects relative to one another, as well to accurately and efficiently secure single object in a desired position and/or orientation.

Embodiments usable within the scope of the present disclosure meet these needs.

SUMMARY

Embodiments usable within the scope of the present disclosure relate to apparatus usable to fasten one or multiple objects (e.g., pictures, racks, mirrors, televisions, shelving, scroll work or similar art objects, etc.) to walls or similar mounting surfaces. A first frame member can be engaged with a second frame member, the frame members being movable (e.g., slidably and/or telescopingly movable) relative to one another along an axis. A first engagement member (e.g., a pin) extending from the first frame member and a second engagement member (e.g., a pin) extending from the second frame member can be used to engage fastening regions of objects (e.g., the orifices and/or fasteners of a picture or similar object), then subsequently to provide markings, indentations, holes, or other types of visible and/or functional features to the mounting surface. An angular measurement device (e.g., a leveler) can be engaged with one of the frame members.

In use, the engagement members can be engaged with fastening regions of objects by moving the frame members relative to one another and rotating the apparatus to accommodate the position of the fastening regions relative to one another. The apparatus can then be disengaged from the objects and positioned on the mounting surface, with the same spacing and angular relationship between the engagement members, such that the engagement members mark and/or otherwise provide a feature to the mounting surface suitable for future installation of fasteners (e.g., nails, screws, hooks, pushpins, etc.) suitable for engaging the object with the mounting surface.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1:
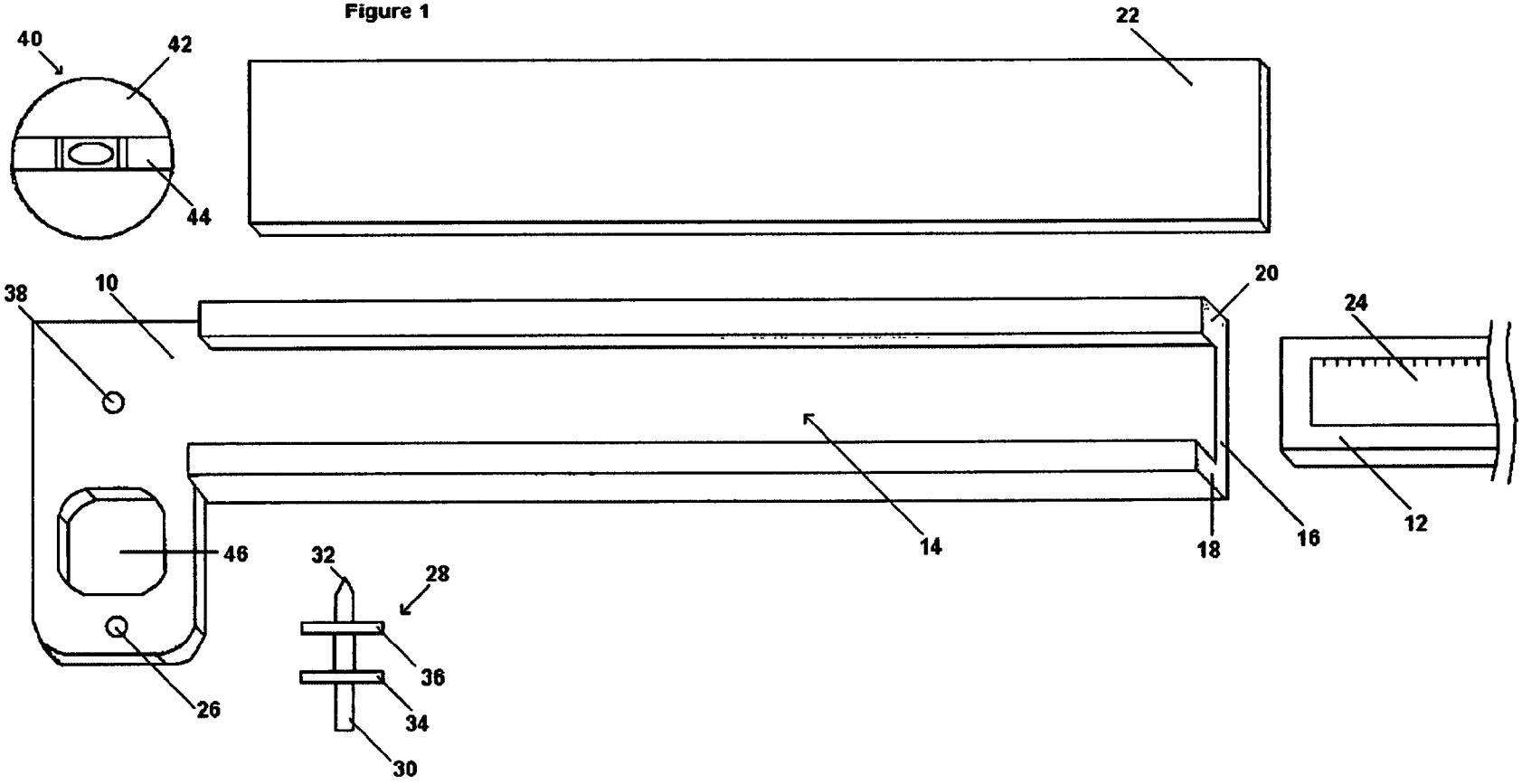
FIG. 1 depicts an exploded view of a first portion of an embodiment of an apparatus usable within the scope of the present disclosure.

Referring now to FIG. 1, an exploded view of a first portion of an embodiment of an apparatus usable within the scope of the present disclosure is shown. Specifically, FIG. 1 depicts a first side of a device that includes, generally, a two-part frame, a first portion thereof being telescopingly movable within a second. A first frame member (hereafter termed main frame (10)) is shown adjacent a second frame member (hereafter termed sliding frame (12)). The sliding frame (12) is insertable and slidably/telescopingly movable within a channel (14), defined within the main frame (10) by a lower wall (16) and two side walls (18, 20). A frame cover (22) is shown, which can be secured over the channel (14), though it should be understood that in other embodiments, a cover (22) could be integrally formed with the main frame (10), or omitted, without departing from the scope of the present disclosure. Additionally, while FIG. 1 depicts the main frame (10), sliding frame (12), and cover (22) as generally elongate, rectangular components, it should be understood that components having any shape and/or dimensions could be used provided that a first portion (e.g., sliding frame (12)) is movable relative to a second portion (e.g., main frame (10)).

The sliding frame (12) is shown having measurement indicia (24) thereon, such that when the sliding frame (12) is extended from the channel (14), as described in greater detail below, the measurement indicia (24) are visible. In an embodiment, the measurement indicia (24) can indicate the length between pin holes (26) of the device, as described below. While FIG. 1 depicts only the front side of the sliding frame (12), in other embodiments, measurement indicia could be included on the opposing side of the sliding frame (12), or on both sides thereof. In a further embodiment, the sliding frame (12) and/or the main frame (10) can include a stop feature, such as protruding portion of one of the sliding frame and the main frame, that contacts a portion of the other of the sliding frame and the main frame, to prevent removal of the sliding frame (12) from the main frame (10).

FIG. 1 depicts the main frame (10) having a generally perpendicular, "L" shape, with a first orifice (hereafter termed pin hole (26)) at one end thereof, and a second orifice (hereafter termed level hole (38)) at the approximate center of the corner of the "L" shape. A sight window (46) is formed in the main frame (10), proximate to the pin hole (26). In use, the pin hole (26) can accommodate a transfer pin (28), which is shown including a generally elongate pin body (30) having a point (32), along which a first stop (34) and a second stop (36) are positioned. The stops (34, 36) are usable both to limit movement of the pin body (30) within the pin hole (26), and to engage fastening regions of a picture or similar object to be positioned, as described below. In an embodiment, the transfer pin (28) can further include a spring or similar biasing member, e.g., between one of the stops (34, 36) and the body of the main frame (10), such that the transfer pin (28) is biased in a direction opposite that of the point (32) to reduce the potential for damage or unintended contact between the point (32) and a user or other objects. The sight window (46) can be used to visualize the fastening region of a picture, a portion of a wall, or other similar object proximate to the pin hole (26), e.g., while positioning and/or suing the transfer pin (28).

The level hole (38) can be usable to accommodate a leveler assembly (40) (e.g., by accommodating a pin, rivet, or similar fastener extending therefrom), which is depicted including a generally circular (e.g., disc-shaped) member (42) to which a bubble leveler (44) is secured. In an embodiment, the leveler assembly (40) can be rotatably secured to the main frame (10), such that the leveler (44) can be rotated to accommodate a variety of angular measurements. In a further embodiment, the leveler (44), circular member (42), and/or main frame (10) can include measurement indicia thereon usable to indicate the angle at which the leveler (44) is positioned relative to the main frame (10). In other embodiments, the leveler (44) could be secured directly to the main frame (10), such that the circular member (42) could be omitted. In further embodiments, the leveler (44) could be fixedly secured to the main frame (10), e.g., at a known angle, such that movable portions of the level assembly (40) could be omitted.

Figure 2:
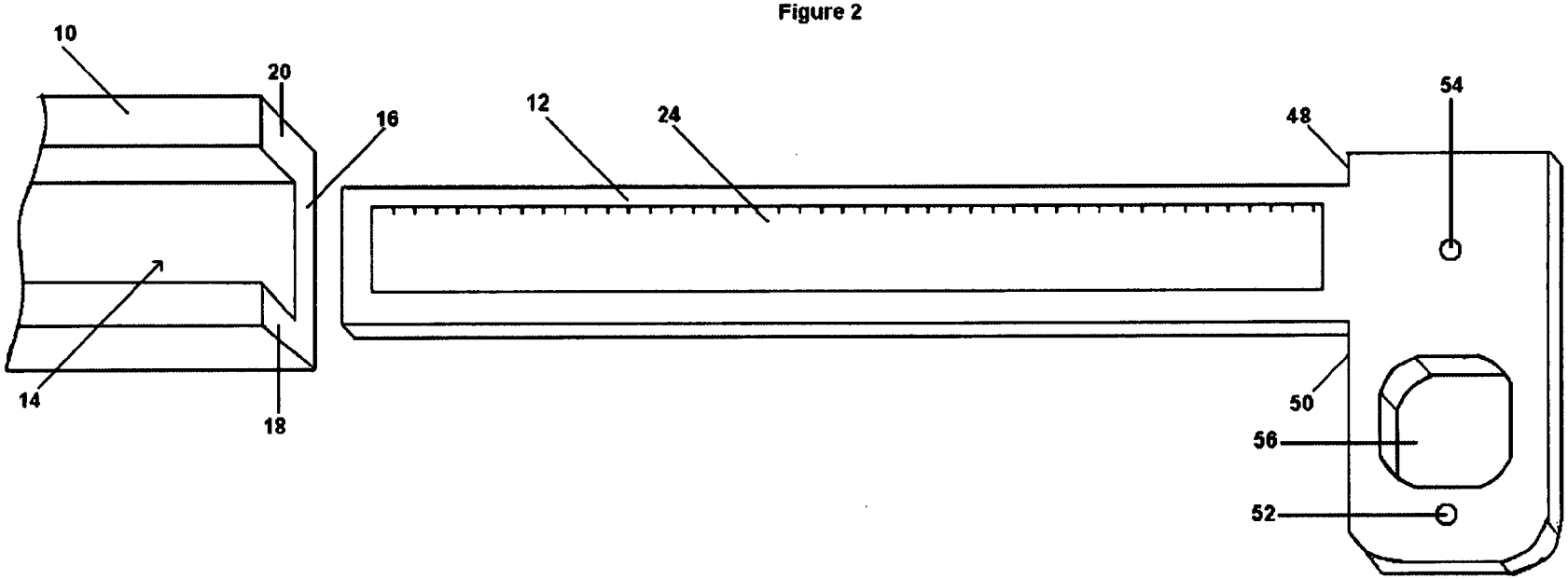
FIG. 2 depicts an exploded view of a second portion of the apparatus shown in FIG. 1.

Referring now to FIG. 2, an exploded view of a second portion of the apparatus shown in FIG. 1 is depicted, in which the sliding frame (12) is shown adjacent to the channel (14) and walls (16, 18, 20) of the main frame (10). The sliding frame (12) is shown having a generally perpendicular, "L" shape, with the measurement indicia (24) disposed on a first arm thereof, a pin hole (52), and sight window (56) disposed on a second arm thereof, and a level hole (54) at the approximate center of the corner of the "L" shape. The pin hole (52) can be usable to accommodate a transfer pin similar or identical to the transfer pin (28) shown in FIG. 1, while the sight window (56) can be usable to visualize the fastening region of a picture, a portion of a wall, or other similar object proximate to the pin hole (52). The leveler hole (54) is usable to accommodate a leveler assembly similar or identical to the leveler assembly (40) shown in FIG. 1. However, it should be understood that in various embodiments, the main frame (10) could accommodate a first type of pin or other transfer member and a first type of leveler or angular measurement device, while the sliding frame (12) could accommodate different types of transfer members and/or measurement devices.

The sliding frame (12) is also shown including protrusions and/or contact shoulders (48, 50), which contact the side walls (20, 18, respectively) of the main frame (10) when the sliding frame (12) is fully inserted into the channel (14), thus limiting movement of the sliding frame (12) relative to the main frame (10).

Figure 3:
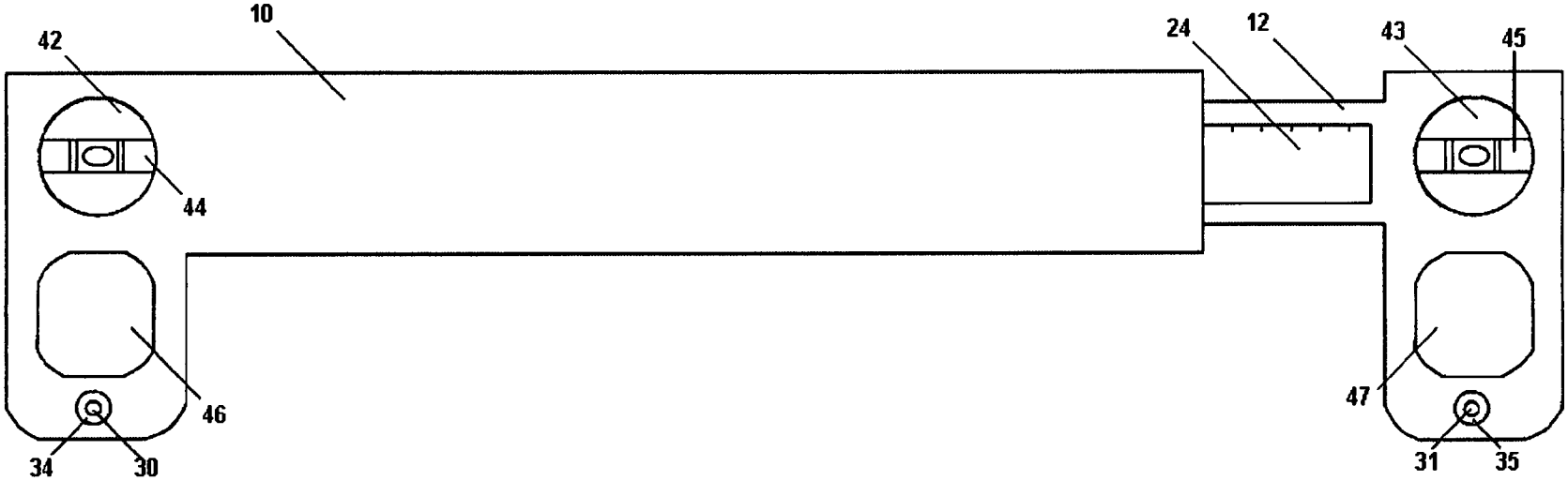
FIG. 3 depicts an assembled, diagrammatic front view of the apparatus shown in FIG. 1 and FIG. 2.

Referring now to FIG. 3, a diagrammatic, front, assembled view of the apparatus of FIG. 1 and FIG. 2 is shown, in which the sliding frame (12) has been inserted into the main frame (10). During normal use, the sliding frame (12) can be slidably movable within the main frame (10), e.g., through insertion and removal of the arm of the sliding frame (12), on which the measurement indicia (24) are disposed, into and from a channel or other similar orifice and/or feature in the main frame (10). The circular member (42) and bubble leveler (44) are shown secured to the main frame (10) (e.g., by engaging the leveler hole (38), shown in FIG. 1), while an additional circular member (43) and bubble leveler (45) are shown secured to the sliding frame (12) (e.g., by engaging the leveler hole (54), shown in FIG. 2). The elongate body (30) and first stop (34) of the transfer pin of FIG. 1 are shown engaged with the main frame (10) (e.g., within the pin hole (26), shown in FIG. 1), while an additional, substantially identical transfer pin assembly, of which an additional pin body (31) and back stop (35) are visible, is shown engaged with the sliding frame (12) (e.g., within the pin hole (52), shown in FIG. 2). The pins are shown proximate to respective sight windows (46, 47). While the depicted stops (34, 35) shown in FIG. 3 can limit movement of the pin bodies (30, 31) within their respective orifices in a first direction, it should be understood, e.g., from the drawing of the transfer pin assembly (28), shown in FIG. 1, that an additional stop (e.g., stop (36), shown in FIG. 1) can be used to limit movement of the pin bodies (30, 31) in the opposing direction and prevent removal of the pin bodies (30, 31) from their respective frames (10, 12).

The body of the apparatus (e.g., the frames (10, 12) and/or cover (22)) can be formed from any generally rigid, durable material, such as injection-molded plastic, wood, aluminum and/or other metals or alloys, or combinations thereof. In an embodiment, one or more of the frames (10, 12) and/or cover (22) can include ribs or other structural features to limit and/or prevent bending thereof and to add durability to all or a portion of the apparatus.

One possible method by which an embodied apparatus can be used is illustrated in FIG. 8, which depicts the apparatus of FIG. 3 engaged with an object (56) to be hung and/or otherwise suspended from and/or secured to a wall or similar surface. While FIG. 8 depicts the object (56) as a frame for containing a picture, it should be understood that embodiments usable within the scope of the present disclosure can be used to facilitate positioning of shelving, towel racks, mirrors, or any other type of object.

In use, the sliding frame (12) can be extended from the main frame (10) a distance sufficient to permit the first transfer pin (30), shown associated with the first back stop (34), to engage a first fastening region of the object (56), and the second transfer pin (31), shown associated with the second back stop (35), to engage a second fastening region of the object (56). Measuring indicia (e.g., on the sliding frame (12), as shown in FIGS. 1-3) can be used to indicate the distance between the first pin (30) and the second pin (31), achieved by positioning the sliding frame (12) relative to the main frame (10), thereby measuring the distance between the fastening regions of the object (56). The sight windows (46, 47) can be used to facilitate positioning the pins (30, 31) within the fastening regions by enabling a user to visualize the object (56) therethrough, rather than attempting to position the pins (30, 31) blindly or by touch.

Figures 8A, 8B, 8C:
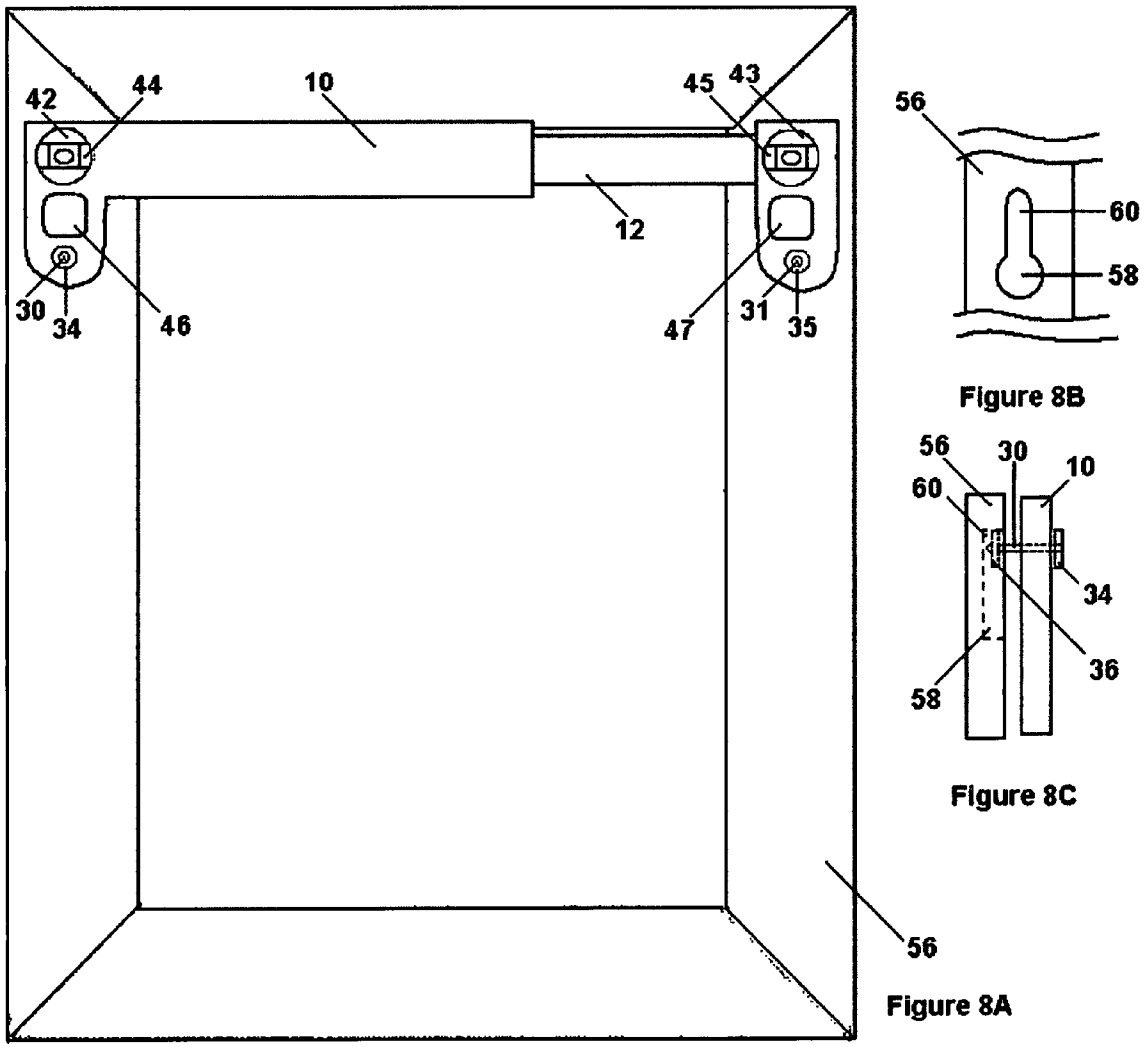
FIG. 8A depicts a diagrammatic front view of the apparatus of FIG. 3 engaged with an object to be hung and/or otherwise suspended from a wall.
FIG. 8B depicts a diagrammatic front view of a fastening region of the object shown in FIG. 8A.
FIG. 8C depicts a diagrammatic side, cross-sectional view of the fastening region of FIG. 8B, engaged with a portion of the apparatus.

To illustrate the engagement of the pins (30, 31) within corresponding fastening regions, FIG. 8B illustrates one possible type of fastening region within the object (56). Specifically, the fastening region is shown as an orifice having a wide, generally round lower portion (58), positioned beneath a narrow, elongate upper portion (60). During normal use, the broad head of a fastener, such as a screw, nail, or pushpin, can pass through the wide lower portion (58), then the object (56) can be lowered such that the narrow body of the fastener passes through the narrower upper portion (60). The smaller width of the upper portion (60) thereby prevents inadvertent removal of the object (56) from the wall or other surface to which it is mounted due to the inability of the broad head of the fastener to pass through the upper portion (60). While the apparatus is engaged with the object (56), the apparatus can be used, e.g., to lift the object (56), such as when it is desired to position the object (56) against a wall or similar mounting surface for visualization purposes.

FIG. 8C shows a side, cross-sectional view of the object (56) engaged with the main frame (10) via the first pin (30). Specifically, a second stop (36) positioned on the pin (30) can be inserted into the fastening region, e.g., through the lower portion (58), then the frame (10) and/or object (56) can be moved such that the body of the pin (30) passes into the upper portion (60) of the orifice. The second pin (31, shown in FIG. 8A) can be positioned within a second fastening region of the object (56) in a similar manner, such that the pins (30, 31) are positioned in a manner corresponding to the position that fasteners for hanging or otherwise securing the object (56) would be positioned. It should be understood that the type of fastening region shown in FIGS. 8B and 8C is merely one example of a type of fastening region for which embodiments of the present apparatus could be used, and that any type of fastening region that includes an orifice able to accommodate a pin (e.g., pin (30), independent of the presence or absence of a stop (e.g., stop (36)) thereon, or any protruding portion able to be accommodated by the pin holes (26, 52, shown in FIGS. 1 and 2, respectively), or by the sight windows (46, 47), could also be engaged with the apparatus. While fastening regions having wide lower portions (58) and narrow upper portions (60) enable objects to remain hung with great stability, such fastening regions are often difficult to access and measure accurately. As such, the apparatus enables enhanced precision by directly engaging the narrow upper portion (60) of the orifice, such that the spacing and angular measurements obtained using the apparatus account for the placement of the specific portion of the fastening region that will ultimately engage a fastener when securing the object (56) to a wall or other surface.

After engaging the object (56) with the apparatus, such as in the manner shown in FIGS. 8A through 8C, the apparatus can be removed from the object (56) while maintaining the sliding frame (12) and main frame (10) in the depicted position relative to one another. In an embodiment, the apparatus can include a thumb screw, clamp, or similar tightening member able to retain the frames (10, 12) in a selected position; however, in other embodiments, friction between the frames could be sufficient to retain the frames in the selected position, a grooved and/or ratchet-like surface could be present on one or both frames, or a user could simply note the measurement indicated on the indicia (e.g., measurement indicial (24), shown in FIGS. 1-3) and reposition the frames (10, 12) after removing the apparatus from the object (56).

Once the apparatus has been removed from the object (56), the apparatus can be positioned against a wall or similar surface to which the object (56) is to be mounted or otherwise secured. Depending on the type of hook and/or fastener to be used to secure the object (56) (e.g., to a wall), the sight windows (46, 47) can be used to accommodate such fasteners and to position the fasteners relative to the object (56) prior to removing the apparatus therefrom, such that the fasteners can be carried with the apparatus. While positioning the frames (10, 12) against a wall, the levelers (44, 45) can be used to ensure that the apparatus (and thus the pins (30, 31) and an imaginary line extending between them) are horizontal. The pins (30, 31) can then be pressed against the wall or other mounting surface to create a mark (e.g., an indentation and/or small hole suitable for installation of a screw, nail, or other type of fastener). The spacing between the pins (30, 31), provided by the relative position of the frames (10, 12), can ensure that the marks created by the pins (30, 31) are spaced a distance equal to the distance between fastening regions of the object (56). The sight windows (46, 47) can facilitate visualization of the wall or other mounting surface during use of the apparatus. The apparatus can then be removed from the wall or other mounting surface, and fasteners can be installed at the location of the marks formed by the pins (30, 31). The object (56) can then be readily positioned on the fasteners. The levelers (44, 45) can be used after suspending the object (56) to verify horizontal placement thereof, such as by placing the apparatus (e.g., upside-down) on top of the object (56).

If it is desired to secure the object (56) at an angle other than horizontal, the levelers (44, 45) can be rotated to the desired angle, such as through rotation of the circular members (42, 43), relative to their respective frames (10, 12). Measurement indicia on the frames (10, 12) and/or circular members (42, 43) can be used to position the levelers (44, 45) accurately at a selected angle, or alternatively, the apparatus could be positioned on a surface that extends at a desired angle (e.g., a stairway), and one or both levelers (44, 45) could be rotated until horizontal, while the apparatus contacts the angled surface. For more complicated undertakings, such as hanging multiple objects relative to one another, hanging an irregularly-shaped object, etc., one of the levelers (44, 45) could be positioned at a first desired angle, while the other leveler could be positioned horizontally, or at a second desired angle.

Figures 6A, 6B:
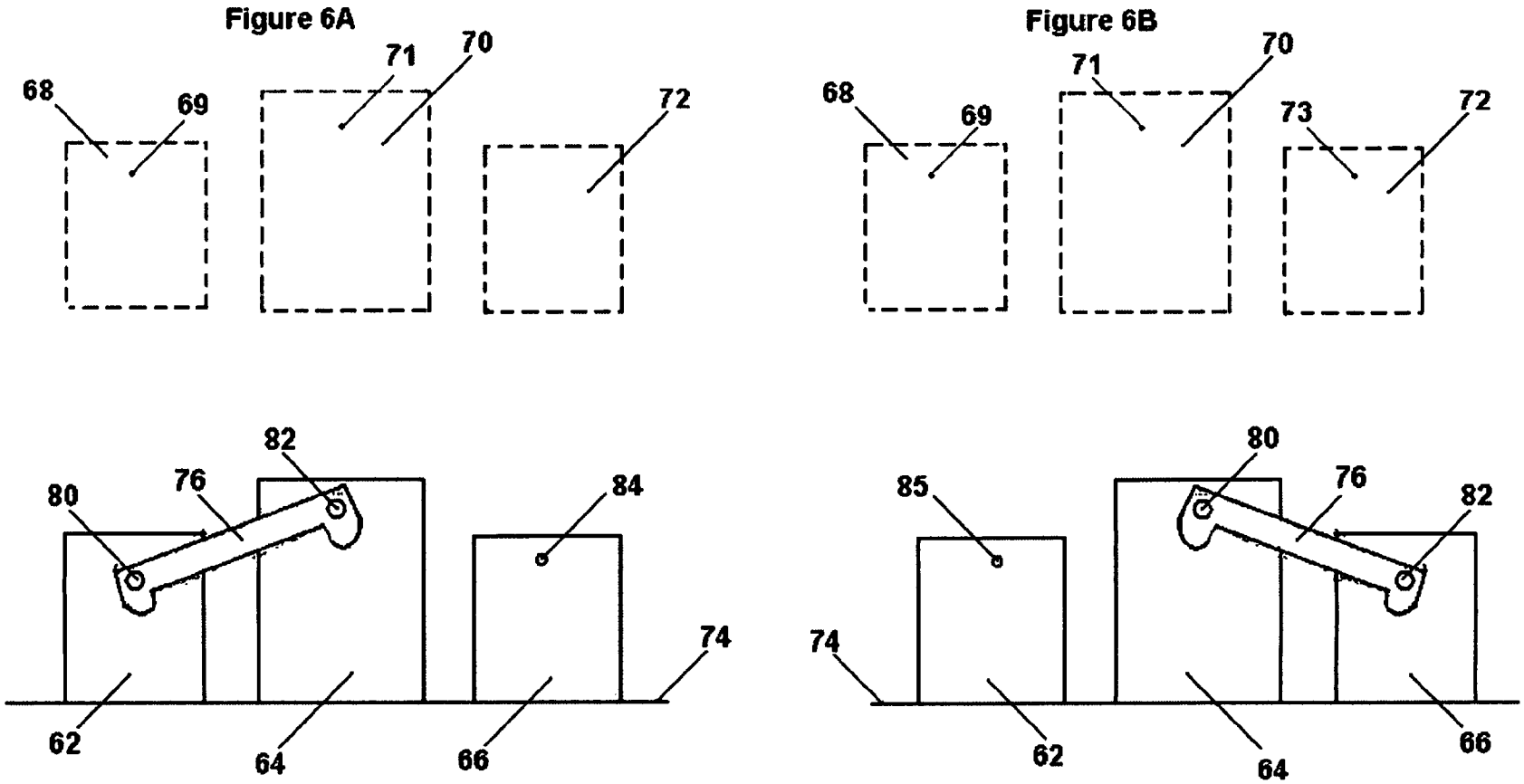
FIG. 6A depicts a diagrammatic front view of an embodiment of an apparatus usable within the scope of the present disclosure engaged with multiple objects to be positioned on a surface relative to one another.
FIG. 6B depicts a diagrammatic front view of the apparatus and objects of FIG. 6A in which the apparatus engages other objects to be positioned on the surface.

Other methods for which embodiments of the present apparatus can be used are illustrated in FIGS. 6A and 6B. Specifically, FIG. 6A depicts a diagrammatic view of an embodiment of an apparatus (76) substantially similar or identical to the apparatus shown in FIG. 3, having two levels (80, 82) rotatably disposed thereon, engaged with fastening regions of two objects (62, 64) (e.g., through insertion of pins of the apparatus (76) into orifices of the objects (62, 64), receipt of protruding portions of the objects (62, 64) into orifices of the apparatus (76), or combinations thereof). More specifically, FIGS. 6A and 6B illustrate a method for positioning multiple objects (62, 64, 66), e.g., three pictures, mirrors, shelves, etc., adjacent to one another, such that the respective lower edges of each object (62, 64, 66) are aligned with one another. For example, the first object (62), can be positioned at a first desired location (68), a the second object (64) can be positioned at a second desired location (70), and the third object (66) can be positioned at a third desired location (72). In FIG. 6A, the fastening region (84) of the third object (66) is visible, while in FIG. 6B, the fastening region (85) of the first object (62) is visible.

To position the objects (62, 64, 66), shown in FIGS. 6A and 6B, at their respective desired positions (68, 70, 72), the objects (62, 64, 66) can first be spaced and/or positioned with the lower edges thereof against an even surface, such as the depicted floor (74). The apparatus (76) can then be engaged with fastening regions of the first object (62) and the second object (64), as shown in FIG. 6A. Depending on the relative heights of the first and second objects (62, 64), the apparatus (76) can be positioned at an angle other than horizontal, and one or both levelers (80, 82) can be positioned appropriately to correspond to the angle of the apparatus (76), as described above.

The apparatus (76) can then be disengaged from the first and second objects (62, 64) and positioned along the wall or other surface to which the objects (62, 64, 66) are to be mounted. In the manner described above, the apparatus (76) can then be used to provide a first marking (69) within the first desired position (68) and a second marking (71) within the second desired position (70), each marking (69, 71) corresponding to the position of a fastener usable to secure the respective objects (62, 64). The position of the frames of the apparatus (76) and the levels (80, 82) can be used to ensure that the spacing of the markings (69, 71) and the angle therebetween correspond to the spacing and angle of the fastening regions of the objects (62, 64).

The apparatus (76) can then be engaged with the fastening regions of the second and third objects (64, 66), as depicted in FIG. 6B, and one or both levels (80, 82) can be adjusted accordingly to correspond to the angle between the fastening regions of the second and third objects (64, 66). In a similar manner, the apparatus (76) can then be disengaged from the second and third objects (64, 66) and positioned against the mounting surface, such that a third marking (73) can be formed in the third desired position (72) at a location relative to the second marking (71) that corresponds to the spacing and angle between the fastening regions of the second and third objects (64, 66). Fasteners can then be positioned at the location of the markings (69, 71, 73) and the three depicted objects (62, 64, 66) can be secured in the respective desired positions (68, 70, 72). Similar steps can be performed to secure any number of objects at any desired orientation relative to one another.

It should be understood that placing markings on the mounting surface (e.g., using pins) between each measurement is not required in various embodiments, but can instead be performed after acquiring multiple measurements. For example, after engaging the apparatus (76) with fastening regions of the first two objects (62, 64), the first leveler (80) can be positioned to record the angle between the fastening regions of the first and second objects (62, 64), and the spacing indicated by measurement indicia in the apparatus (76) can be noted. The apparatus (76) can then be engaged with the fastening regions of the second and third objects (64, 66), and the second leveler (82) can be positioned to record the angle between the fastening regions of the latter two objects (64, 66), while the spacing indicated by measurement indicia in the apparatus (76) can be noted. The apparatus (76) can then be positioned along the mounting surface at the first noted spacing, and at the angle indicated by the first leveler (80) to create the first and/or second markings (69, 71), and can subsequently be repositioned at the second noted spacing and at the angle indicated by the second leveler (82) to create the second and/or third markings (71, 73).

Figure 7:
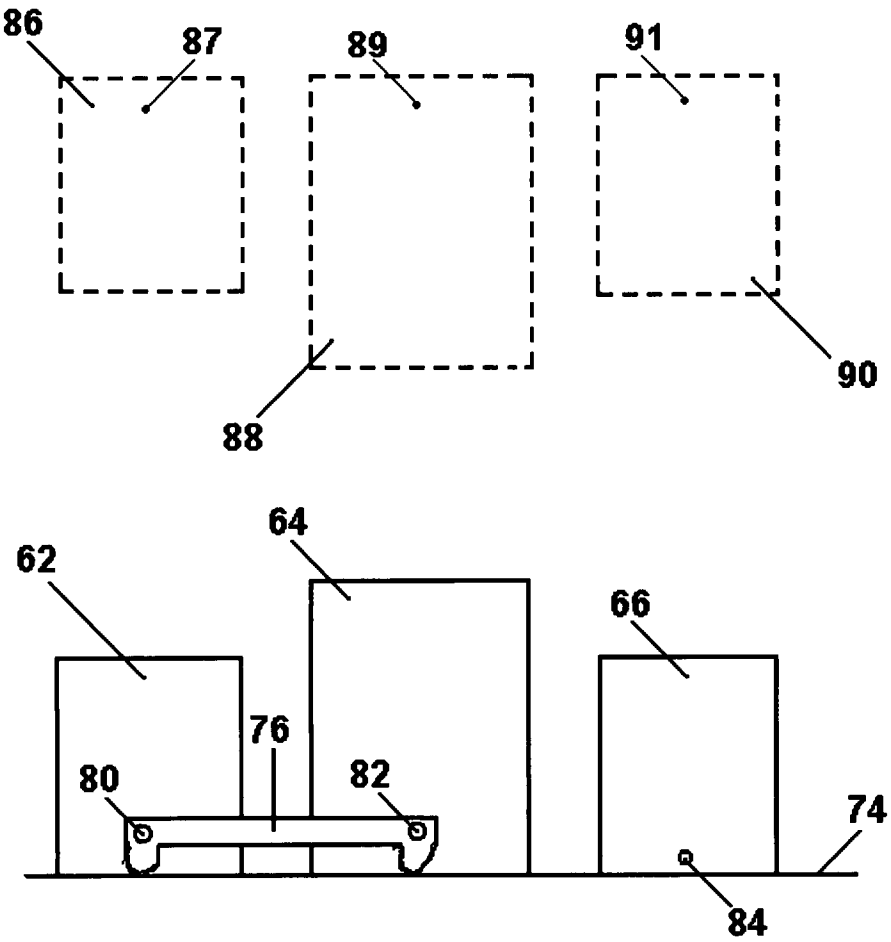
FIG. 7 depicts a diagrammatic front view of an embodiment of an apparatus usable within the scope of the present disclosure engaged with multiple objects to be positioned on a surface relative to one another.

FIG. 7 illustrates an alternate method for positioning multiple objects (62, 64, 66), e.g., three pictures, mirrors, shelves, etc., adjacent to one another such that the respective upper edges of each object (62, 64, 66) are aligned with one another. For example, the first object (62), can be positioned at a corresponding first desired location (86), a the second object (64) can be positioned at a corresponding second desired location (88), and the third object (66) can be positioned at a corresponding third desired location (90). In FIG. 7, the fastening region (84) of the third object (66) is visible, while the fastening regions of the first and second objects (62, 64) are hidden from view by engagement of the apparatus (76) therewith (e.g., through insertion of pins of the apparatus (76) into orifices of the objects (62, 64), receipt of protruding portions of the objects (62, 64) into orifices of the apparatus (76), or combinations thereof). The apparatus (76) is shown having two levelers (80, 82) rotatably positioned thereon.

To position the objects (62, 64, 66) at their corresponding desired positions (86, 88, 90), the objects (62, 64, 66) can first be positioned with the upper edges thereof against an even surface, such as the depicted floor (74) (e.g., by placing the objects upside-down along the floor (74)). The apparatus (76) can then be engaged with fastening regions of the first object (62) and the second object (64), as shown. Depending on the relative height of the fastening regions of the first and second objects (62, 64) from the floor (74), the apparatus (76) can be positioned at an angle other than horizontal, and one or both levelers (80, 82) can be positioned appropriately to correspond to the angle of the apparatus (76), as described above.

The apparatus (76) can then be disengaged from the first and second objects (62, 64) and positioned along the wall or other surface to which the objects (62, 64, 66) are to be mounted. In the manner described above, the apparatus (76) can then be used to provide a first marking (87) within the first corresponding position (86) and a second marking (89) within the second corresponding position (88), each marking (87, 89) corresponding to the position of a fastener usable to secure the respective objects (62, 64). The position of the frames of the apparatus (76) and the levels (80, 82) can be used to ensure that the spacing of the markings (87, 89), and the angle therebetween, correspond to the spacing and angle of the fastening regions of the objects (62, 64).

The apparatus (76) can then be engaged with the fastening regions of the second and third objects (64, 66), similar to the process shown in FIG. 6B, and one or both levelers (80, 82) can be adjusted accordingly to correspond to the angle between the fastening regions of the second and third objects (64, 66). In a similar manner, the apparatus (76) can then be disengaged from the second and third objects (64, 66) and positioned against the mounting surface, such that a third marking (91) can be formed in the third corresponding position (90) at a location relative to the second marking (89), which corresponds to the spacing and angle between the fastening regions of the second and third objects (64, 66). Fasteners can then be positioned at the location of the markings (87, 89, 91) and the three depicted objects (62, 64, 66) can be secured in the corresponding desired positions (86, 88, 90). Similar steps can be performed to secure any number of objects at any desired orientation relative to one another.

It should be understood that the methods described above and illustrated in FIGS. 6 through 8C are merely exemplary and that any number of objects can be positioned at any desired orientation through use of embodiments of the present apparatus. For example, objects could be positioned on a wall, in vertical alignment with one another, by standing or laying multiple objects in a desired orientation, engaging the apparatus with fastening regions thereof, positioning a leveler to indicate a vertical angle, then positioning the apparatus against the wall at the spacing and angle indicated by the apparatus to form markings on the wall corresponding to the location of the fastening regions of the objects. Other non-horizontal angles can also be accommodated, such as when arranging pictures or other objects in a diagonal (e.g., "stair-stepped") arrangement.

It should also be understood that the illustrated and described methods could be used in combination with one another. For example, while FIGS. 6A, 6B, and 7 depict objects (62, 64, 66), each having a single fastening region, multiple objects having two or more fastening regions could be secured, for example, by engaging the apparatus with multiple fastening regions of a first object, providing markings to a wall, engaging a first portion of the apparatus with a fastening region in the first object and a second portion of the apparatus with a fastening region in a second object, then providing markings to the wall, relative to the previous markings, using the spacing and angle measured by simultaneously engaging the apparatus with the first and second objects. Generally, the initial marking or set of marks placed on a wall or other surface can serve as a reference location for placement of subsequent markings corresponding to fastening regions of subsequent objects, and similarly, other previously-placed markings can be used to position subsequent markings corresponding to subsequent fastening regions and objects, as needed.

Figure 4:
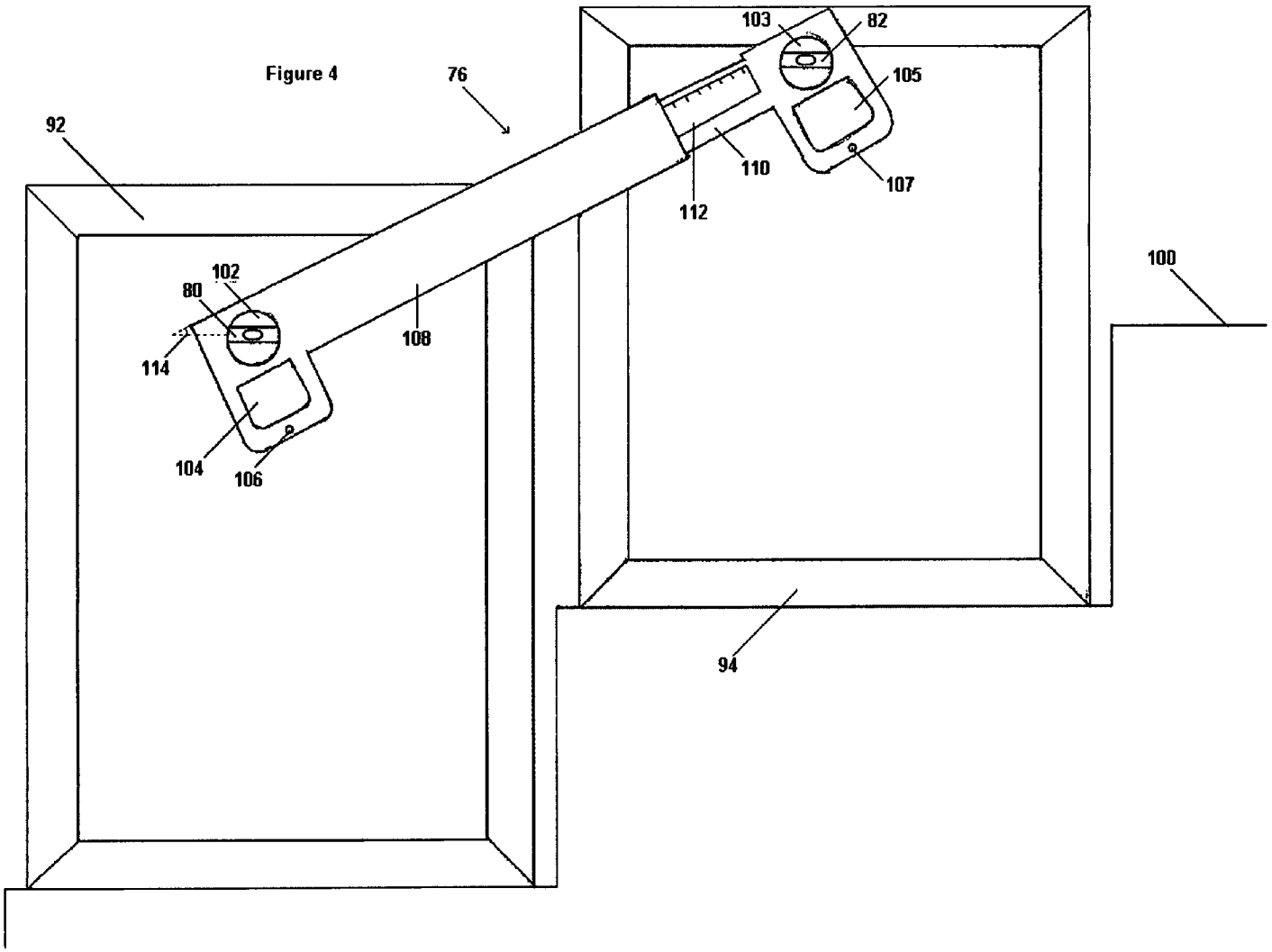
FIG. 4 depicts a diagrammatic front view of an embodiment of an apparatus usable within the scope of the present disclosure engaged with multiple objects to be positioned on a surface relative to one another
Figure 5:
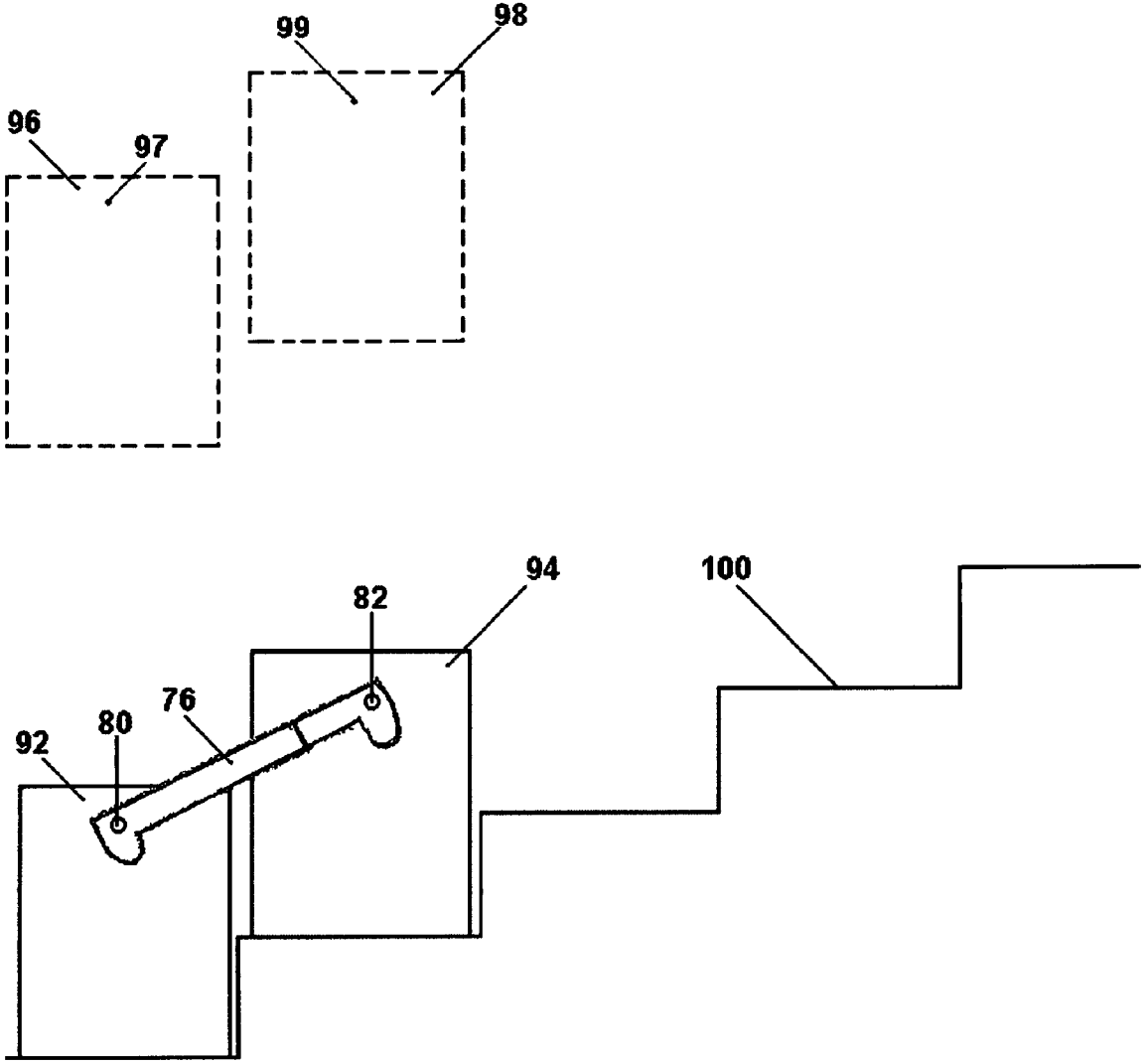
FIG. 5 depicts a diagrammatic front view of the apparatus and objects of FIG. 4.

FIGS. 4 and 5 depict an embodiment of an apparatus (76) usable within the scope of the present disclosure, illustrating a method by which multiple objects (92, 94) can be positioned in a "stair-stepped" arrangement, such as when it is desired to hang pictures or similar objects along a wall adjacent to a stairway, or to place objects spaced diagonally from one another, e.g., for aesthetic reasons. FIG. 5 shows a diagrammatic view, depicting the objects (92, 94) relative to desired positions (96, 98) along a wall to which the objects (92, 94) are to be secured. FIG. 4 shows a close-up view, depicting the engagement between the apparatus (76) and objects (92, 94) in greater detail.

The first and second objects (92, 94), which are depicted as framed pictures, are shown positioned with the lower edges thereof against a surface having a desired angle, such as the depicted stairway (100). FIG. 4 depicts the apparatus (76) engaged with fastening regions of both objects (92, 94), e.g., through engagement of a first pin (106) with a fastening region of the first object (92), and a second pin (107) with a fastening region of the second object (94). Sight windows (104, 105) are usable to visualize the fastening region and/or other objects (e.g., the wall or surface to which fasteners are to be attached) while manipulating the apparatus (76). To accommodate simultaneous engagement of the apparatus (76) with both depicted objects (92, 94), the apparatus is shown having a sliding frame (110) extended from a main frame (108) a selected distance. Measurement indicia (112) on the apparatus (76) can indicate the linear distance between the first and second pins (106, 107), while the levelers (80, 82) can be used to record the angle (114) at which the apparatus (76) is positioned, thereby recording the relative angle between fastening regions of the objects (92, 94). For example, FIG. 4 depicts the first leveler (80) positioned on a first circular member (102), which can be rotated such that the leveler (80) is generally horizontal while the main frame (108) is positioned at a non-horizontal angle. FIG. 4 further depicts the second leveler (82) positioned on a second circular member (103), which can be rotated such that the leveler (82) is generally horizontal while the sliding frame (110) is positioned at a non-horizontal angle.

After the apparatus (76) has been used to measure the spacing and angle between the fastening regions of the objects (92, 94), the apparatus (76) can be disengaged therefrom and positioned within the desired positions (96, 98), shown in FIG. 5, along the wall or other mounting surface. The apparatus (76) (e.g., the pins (106, 107) thereof) can be used to form a first marking (97) within the first desired position (96), and a second marking (99) within the second desired position (98), the markings (97, 99) corresponding to the location where fasteners (e.g., nails, screws, hooks, pushpins, etc.) can be installed to accommodate the fastening regions of the objects (92, 94).

Embodiments usable within the scope of the present disclosure thereby relate to apparatus and methods that can be used to position any number of objects along a surface, at any desired positions relative to one another, such objects including, for example, pictures, mirrors, shelving, towel racks, ornamental artwork (e.g., metal scroll work), or any other object that could be secured to a wall or similar mounting surface, without requiring conventional tools such as a tape measure or marking implements.

Using embodied apparatus, multiple pictures or similar objects can be hung horizontally, in desired positions having the upper or lower edges thereof in alignment, or vertically having either side edge in alignment. For example, pictures can be placed on the floor, leaning against a wall, with the fastening regions facing outward, and spaced apart as desired, so that an embodied apparatus can be engaged therewith. The apparatus can then be used to apply markings, holes, indentations, etc. to the wall or other mounting surface, such markings, holes, and/or indentations having the same spacing and angular relationship as the fastening regions of the objects. Similarly, pictures or similar objects can be hung in a diagonal "stair-step" arrangement simply by arranging the objects in the desired relationship (e.g., by placing them on a stairway) prior to engaging the apparatus therewith.

Once a first marking or set of markings has been provided to a mounting surface, additional markings can be positioned relative to previously-formed marks by placing a first portion of the apparatus (e.g., a pin thereof) in a pre-existing marking, then positioning a second portion of the apparatus (e.g., a pin thereof) at a selected spacing and angle relative to the first.

A picture, mirror, or similar object, having two or more fastening regions, can be secured to a wall or similar mounting surface by engaging the apparatus with multiple fastening regions, then using the apparatus to apply markings, holes, indentations, etc. to the wall or other mounting surface, such markings, holes, and/or indentations having the same spacing and angular relationship as the fastening regions of the object.

In other embodiments, the pins or similar portions of the apparatus could be provided with a known spacing therebetween (e.g., 16 inches), and the apparatus can be used to form spaced markings along a wall or other surface, such as when installing shelving, thereby eliminating the need to separately measure or create other markings on a wall.

When hanging ornamental artwork, such as metal scroll work, or similar objects that lack a defined fastening region, the transfer pins or similar portion of the apparatus can simply be placed at locations along the object where a user may wish to hang the object via a nail or similar fastener, and the levels of the apparatus can be adjusted to indicate the angle of the apparatus. The apparatus can then be used to provide markings to a wall or other mounting surface, such markings corresponding to the selected fastening locations for the object.

Thus, embodiments usable within the scope of the present disclosure can enable a single user to align, space, position, and/or hang any object at a desired position and/or orientation, or multiple objects relative to one another, with great accuracy and efficiency.

While various embodiments of the present invention have been described with emphasis, it should be understood that within the scope of the appended claims, the present invention might be practiced other than as specifically described herein.

What is claimed is:

1. A measuring apparatus for fastening one or multiple objects to a surface, the apparatus comprising:

a first frame member comprising a first arm extended parallel to an axis and a second arm extending perpendicular to the first arm;

wherein the first frame member comprises a channel, a bore, an orifice, or combinations thereof, within which a portion of the second frame member is movable, further wherein the first frame member comprises a first side wall, a second side wall, a bottom wall, and a top wall, wherein said first side wall, second side wall, bottom wall, and top wall define the channel;

a second frame member engaged with the first frame member, wherein the second frame member is slidably movable relative to the first frame member along the axis;

wherein the second frame member comprises an elongate portion telescopingly movable into and from the channel to position the second engagement member a distance from the first engagement member along the axis;

a first engagement member extending from the first frame member and positioned on the second arm;

a second engagement member extending from the second frame member; and a first angular measurement device engaged with the second arm of the first frame member, wherein the first angular measurement device accommodates a variety of angular measurements.

2. A measuring apparatus for fastening one or multiple objects to a surface, the apparatus comprising:

a first frame member comprising a first arm extended parallel to an axis and a second arm extending perpendicular to the first arm;

a second frame member engaged with the first frame member, wherein the second frame member is slidably movable relative to the first frame member along the axis;

wherein the first frame member, the second frame member, or combinations thereof comprise measurement indicia thereon, and wherein the measurement indicia indicate a linear distance between the first engagement member and the second engagement member;

a first engagement member extending from the first frame member and positioned on the second arm;

a second engagement member extending from the second frame member; and a first angular measurement device engaged with the second arm of the first frame member, wherein the first angular measurement device accommodates a variety of angular measurements.

3. A measuring apparatus for fastening one or multiple objects to a surface, the apparatus comprising:

a first frame member comprising a first arm extended parallel to an axis and a second arm extending perpendicular to the first arm;

a second frame member engaged with the first frame member, wherein the second frame member is slidably movable relative to the first frame member along the axis;

a first engagement member extending from the first frame member and positioned on the second arm;

a second engagement member extending from the second frame member;

wherein the first engagement member, the second engagement member, or combinations thereof comprise a pin;

wherein the pin extends in a direction generally perpendicular to the axis;

wherein the pin further comprises a first portion having a first width and a second portion having a second width greater than the first width;

wherein the pin further comprises a third portion having a third width greater than the first width; and a first angular measurement device engaged with the second arm of the first frame member, wherein the first angular measurement device accommodates a variety of angular measurements.

4. The apparatus of claim 3, wherein the pin is positioned within a bore in the apparatus, wherein the bore extends perpendicular to the axis, wherein the second portion of the pin is positioned on a first side of the bore, and wherein the third portion of the pin is positioned on a second side of the bore opposite the first side.

5. The apparatus of claim 4, further comprising a biasing member associated with the pin, wherein the biasing member urges the pin toward the first side.

6. A measuring apparatus for fastening one or multiple objects to a surface, the apparatus comprising:

a first frame member comprising a first arm extended parallel to an axis and a second arm extending perpendicular to the first arm;

a second frame member engaged with the first frame member, wherein the second frame member is slidably movable relative to the first frame member along the axis;

wherein the second frame member comprises a third arm extended parallel to an axis and a fourth arm extending perpendicular to the third arm a first engagement member extending from the first frame member and positioned on the second arm;

a second engagement member extending from the second frame member and positioned on the third arm;

wherein the second arm of the first frame member includes a first orifice formed proximate to the first engagement member for visualizing objects through the first frame member, wherein the fourth arm of the second frame member includes a second orifice formed proximate to the second engagement member for visualizing objects through the second frame member, or combinations thereof; and a first angular measurement device engaged with the second arm of the first frame member, wherein the first angular measurement device accommodates a variety of angular measurements.

7. A measuring apparatus for fastening objects to a surface, the apparatus comprising:

a main frame having a first arm perpendicular to a second arm, wherein the first arm comprises a channel formed therein;

a sliding frame having a third arm perpendicular to a fourth arm, wherein the third arm is received in and slidably movable within the channel of the first arm;

a first engagement member extending from the second arm in a direction perpendicular to the first arm and the second arm;

a second engagement member extending from the fourth arm in the direction perpendicular to the first arm and the second arm;

measurement indicia positioned on at least one of the main frame and the sliding frame, wherein the measurement indicia indicate a distance between the first engagement member and the second engagement member; and at least one angular measurement device positioned on the main frame, the sliding frame, or combinations thereof, wherein said at least one angular measurement device is rotatable relative to the main frame, the sliding frame, or combinations thereof, further wherein the at least one angular measurement device accommodates a variety of angular measurements.

8. The apparatus of claim 7, further comprising a first sight window formed in the main frame proximate to the first engagement member for visualizing objects through the main frame and a second sight window formed in the sliding frame proximate to the second engagement member for visualization objects through the sliding frame.

9. The apparatus of claim 7, wherein the first engagement member occupies a bore in the main frame, wherein the first engagement member is movable within the bore, wherein the first engagement member further comprises a first stop positioned on a first side of the bore and a second stop positioned on the second side of the bore, and wherein the first stop and the second stop comprise a dimension greater than a diameter of the bore.

* * * * *